US008465071B2

(12) United States Patent
Risi et al.

(10) Patent No.: US 8,465,071 B2
(45) Date of Patent: Jun. 18, 2013

(54) MULTIPLE-UNIT INDEXING CLAMP WITH MATING VERTICALLY-GROOVED STACKING UNITS

(76) Inventors: Angelo Risi, Richmond Hill (CA); Tyler Matys, Aurora (CA)

( * ) Notice: Subject to any disclaimer, the term of this patent is extended or adjusted under 35 U.S.C. 154(b) by 16 days.

(21) Appl. No.: 13/236,783

(22) Filed: Sep. 20, 2011

(65) Prior Publication Data

US 2012/0068485 A1 Mar. 22, 2012

Related U.S. Application Data

(60) Provisional application No. 61/384,869, filed on Sep. 21, 2010.

(51) Int. Cl.
*B66C 1/44* (2006.01)

(52) U.S. Cl.
USPC ..... 294/110.2; 294/63.1; 294/118

(58) Field of Classification Search
USPC ..... 294/110.1, 110.2, 104, 118, 902, 294/63.1
See application file for complete search history.

(56) References Cited

U.S. PATENT DOCUMENTS

| | | | | |
|---|---|---|---|---|
| 1,577,347 | A * | 3/1926 | Neumann | 294/63.1 |
| 1,974,892 | A * | 9/1934 | Poliakoff | 294/63.1 |
| 2,088,519 | A * | 7/1937 | Hershey | 294/63.1 |
| 2,229,359 | A * | 1/1941 | York | 294/118 |
| 2,812,972 | A * | 11/1957 | Elberty | 294/104 |
| 3,051,521 | A * | 8/1962 | Skowron | 294/110.1 |
| 3,451,711 | A * | 6/1969 | Carpenter | 294/113 |
| 6,331,025 | B1 * | 12/2001 | Douglas | 294/110.1 |
| 6,568,731 | B2 * | 5/2003 | Alexander et al. | 294/110.1 |
| 7,673,918 | B2 * | 3/2010 | Cveykus | 294/118 |

* cited by examiner

*Primary Examiner* — Dean Kramer
(74) *Attorney, Agent, or Firm* — Collard & Roe, P.C.

(57) ABSTRACT

Disclosed is multiple-unit indexing, mechanical scissor clamp for handling one or more modular segmental retaining wall units, also called "SRW blocks" having opposite ends each provided with a vertical groove. This clamp allows the user to move SRW blocks from a shipping pallet to a wall. The clamp and blocks are lifted using traditional construction machinery such as a backhoe, crane, bobcat, etc. The significant innovation of this clamp/block system is the ability to lift and place more than one large segmental retaining wall block with each installation cycle, substantially increasing installation efficiency.

2 Claims, 9 Drawing Sheets

MULTIPLE-UNIT INDEXING CLAMP WITH MATING VERTICALLY-GROOVED STACKING UNITS

CROSS REFERENCE TO RELATED APPLICATIONS

Applicants claims priority under 35 U.S.C. §119(e) of U.S. Provisional Patent Application Ser. No. 61/384,869 filed Sep. 21, 2010, the disclosure of which is incorporated by reference.

FIELD OF THE INVENTION

The present invention relates to a frictional, indexing, mechanical scissor clamp hereinafter also called "handling system" that has been designed to be used together with new pre-cast, concrete segmental retaining wall units, also called "SRW block".

The clamp is used for the construction of a segmental retaining wall, allowing the user to move SRW blocks from the shipping pallet to the wall. The clamp and blocks are lifted using traditional construction machinery such as a backhoe, crane, bobcat, etc. The significant innovation of this clamp/block system is the ability to lift and place more than one large segmental retaining wall block with each installation cycle, substantially increasing installation efficiency.

BACKGROUND OF THE INVENTION

Segmental retaining walls are a category of earth retention systems that utilize modular, dry stacked, pre-cast concrete blocks to create a stable mass with sufficient weight to resist earth pressures developed by the adjacent soil.

The modular, segmental retaining wall units (SRW blocks) vary in shape and size. Smaller units can be placed by hand (up to 80 lbs) using manual labour. It has been our experience that landscape and construction contractors are having an increasingly difficult time finding reliable manual labourers to install hand placed blocks.

As such, machine placeable units are becoming more and more popular each year. Machine placeable units are SRW blocks that are too large (heavy) to be placed by hand, and require the use of heavy construction machinery (backhoe, crane, etc.) that is outfitted with a specialized clamping device to move them.

As will be explained hereinafter, the present invention is actually an improvement to the existing scissor clamps of which the basic structure is disclosed below, which improvement is adapted for use in combination with a new SRW unit that has been designed to accommodate it.

Existing scissor clamps are actually mechanical devices, normally fabricated from structural steel components, that are designed to securely hold and lift construction materials. These clamps are commonly used to handle individual concrete retaining wall units, concrete pavers, building blocks, etc.

These clamps use freely rotating pin connections to create a scissor configuration with a system of structural steel elements.

The "arms" of each scissor clamp are configured to rotate towards each other about two fixed points in reaction to the clamp being lifted vertically from the midpoint. The arms rotate inwards and generate a compression force on the object to be lifted. At the interface between the object (concrete unit, block) and the clamp arms are rubberized pads. The compression force generated as the clamp arms rotate towards each other results in friction between the object and pads. The frictional force is sufficient to securely hold the self weight of the object, and prevent it from slipping out of the clamp. Essentially, the self weight of the clamp and block is used to generate this clamping action.

With the concrete block held securely in place, the construction machinery is able to lift and move the clamp and object from point to point.

In the context of machine placed segmental retaining walls, the existing scissor clamps have been designed to pick up one (1) unit at a time. Most commonly, each scissor clamp is oriented perpendicular to the unit, and the pads are facing the front and back of the block.

In most cases, the units arrive at the site in bundles on large wood pallets. The units are normally facing each other on the pallet.

In order to pick an SRW block up from the front and back face (perpendicular orientation to the block) using the existing scissor clamp as described above, the SRW blocks on the pallet must be separated to allow the clamp to slide into place. This is often done by a worker using a crow bar and can be difficult and time consuming.

SUMMARY OF THE INVENTION

As aforesaid, the present invention is directed to a multi-unit indexing, mechanical scissor clamp intended to be used in conjunction with a very specific SRW block especially designed to be used with it. As a result, several aspects are improved upon to allow for increased efficiency and speed of construction. The clamp is designed to pinch the units end to end (clamp arms are parallel to the unit), putting the entire block in compression along its length.

More particularly, the invention is directed to a multiple-unit indexing, mechanical scissor clamp for handling one or more modular segmental retaining wall units, also called "SRW blocks" having opposite ends each provided with a vertical groove, wherein said indexing clamp comprises:

- a rigid clamp arm sized to fit into one of the grooves of the SRW unit;
- a moving clamp arm pivotably connected to the rigid clamp arm and sized to fit into the opposite groove of the same SRW unit; and
- a pair of hanger bars having upper ends pivotably connected to each other by a horizontal pin that is slideably moveable up and down into a groove forming a travel path with different holding positioning in a vertical indexing element, said hanger bars also having bottom ends respectively connected to the rigid and moving clamp arms in order to allow them to open and close while the pin moves through the travel path; and
- an indexing foot also connected to the horizontal pin, said indexing foot being slideably mounted into the vertical indexing element and projecting downwardly from the same to contact the SRW block located just below.
- whereby, in use, positioning of the indexing clamp onto one or more stacked SRW blocks to be left, causes the indexing foot to move up and thus to cause the pin to move up also through the travel path until it reaches a suitable position where the clamp arms are actuated to catch the SRW block left in the lower position, and allow it and all the others that may be stacked on it, to be left.

As may be understood, the SRW blocks used with the clamp according to the invention, are designed to accommodate the arms of the clamp (that are optionally provided with gripping pads, by incorporating vertical grooves also called "channels") in opposite ends of the block. These channels are perfectly centered to balance the block within the clamp. These channels not only provide enough room for the clamp arms, but allow the block to be placed immediately adjacent to another unit.

Without the channels, a block would have to be placed next to another block, the clamp would have to be removed, then the blocks would have to be shifted together manually. As the clamp grabs the unit from its ends, there is no longer a need to separate the columns on the pallet.

As also mentioned above, the scissor clamp according to the invention is provided with an intricate indexing element and an index foot which allow the placement of multiple units with each installation cycle. The clamp can grasp an entire column from the pallet. In the case of the current system, the SRW units are stacked three courses high, although this number could be increased. Then, the clamp transfers the SRW unit directly to the wall. The travel of the index foot determines the number of units that can be picked up. That is, the travel of the index foot determines the "bay size" of the clamp.

The invention and its use will be better understood upon reading the following non restrictive description of a preferred embodiment thereof made with reference to the drawings.

BRIEF DESCRIPTION OF THE DRAWINGS

1. Moving Clamp Arm
2. Rigid Clamp Arm
3. Upper Single Hanger Bar
4. Upper Double Hanger Bars
5. Free rotation pin joint (all are alike)
6. Rubber Friction Pads
7. Indexing Element
8. Indexing Foot

FIGS. 5 A to F are front views of the indexing channel/foot system in various positions shown for a three units installation cycle, in which:

Position A: Start Point (ready to be lowered on top of stack of units);

Position B: First Stop. Clamp is at lowest position. Clamp picks up full stack.

Position C: First Hanging Position. First Unit is placed and clamp is lifted to Position C where the foot catches. This allows the clamp to move up the stack, leaving the first unit, indexing up by 1 unit.

Position D: Second Stop. Clamp is lowered to position D, where it stops and the arms grip the remaining two units.

Position E: Second Hanging Position. Second unit is placed and clamp is lifted to Position E, where the foot catches. This allows the clamp to move up the stack, leaving the second unit, and indexing up by 1 more unit.

Position F: Third Stop. This position lifts the last unit.

Figure 6:
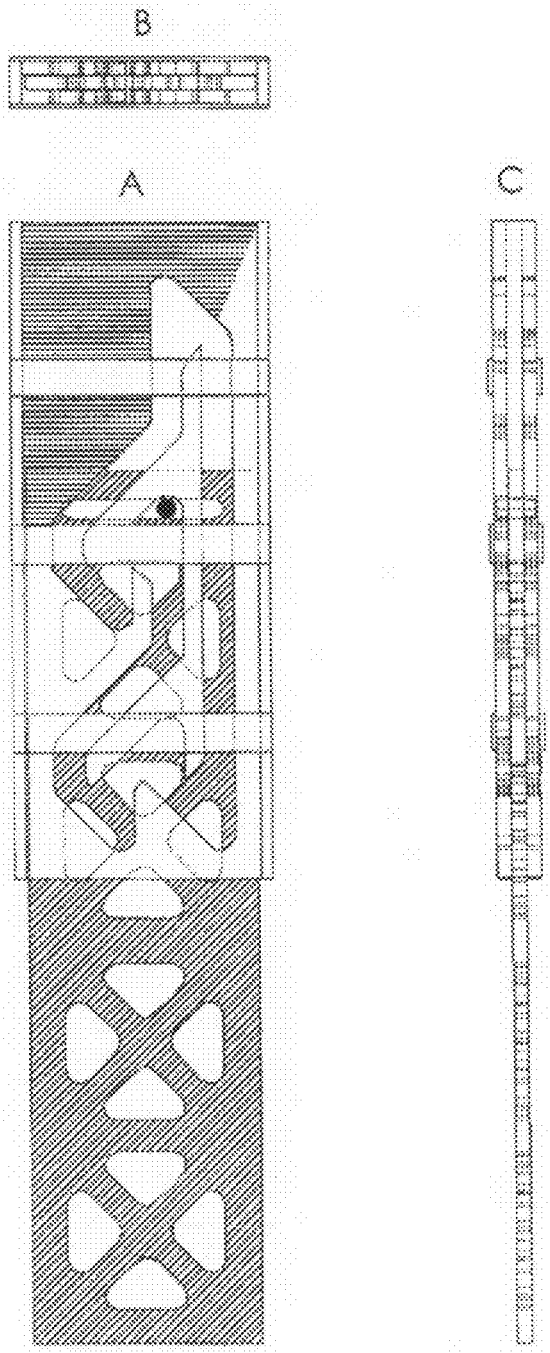
Figure 7:
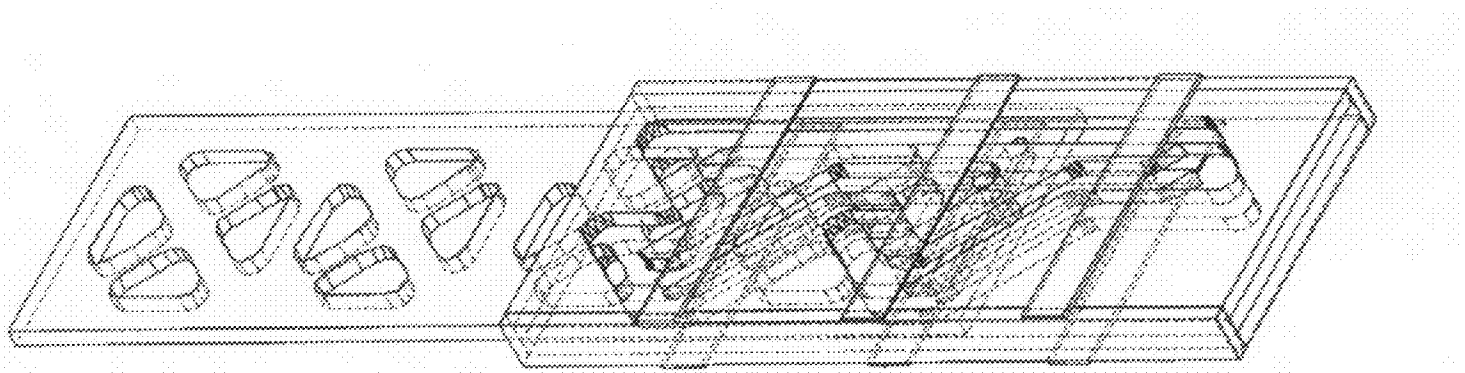
Figure 8A:
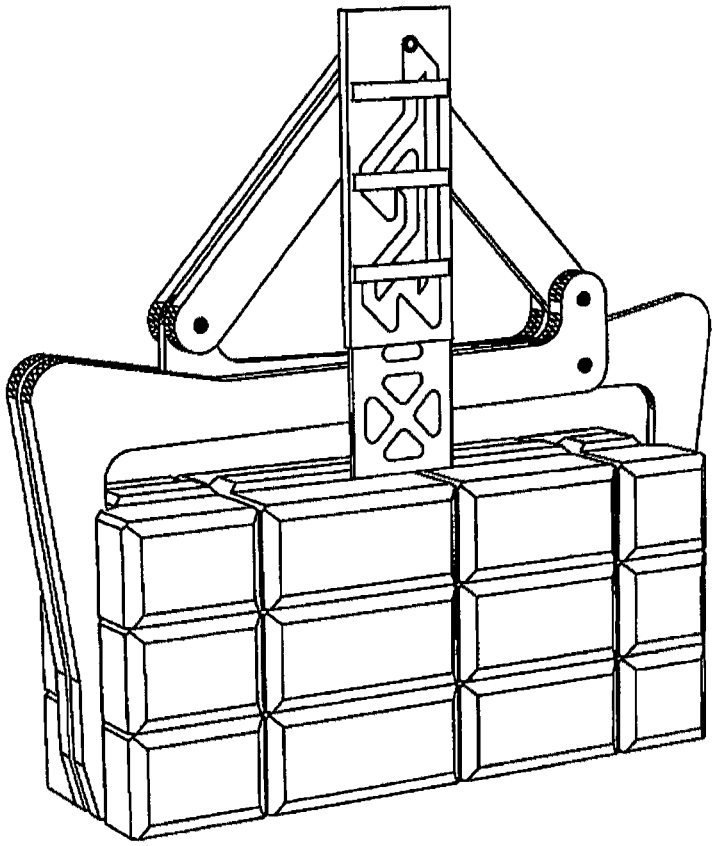
Figure 8B:
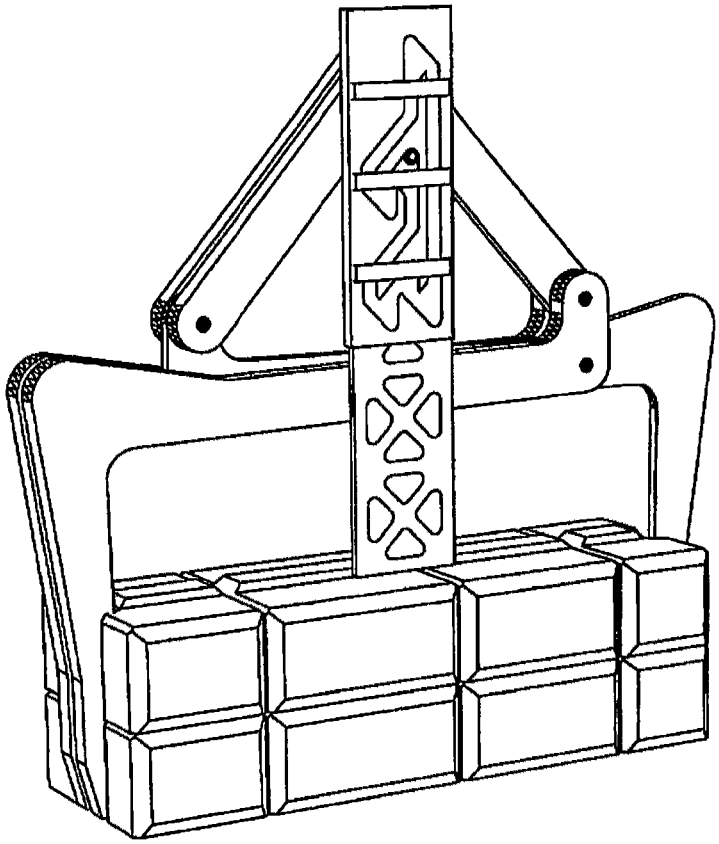
Figure 8C:
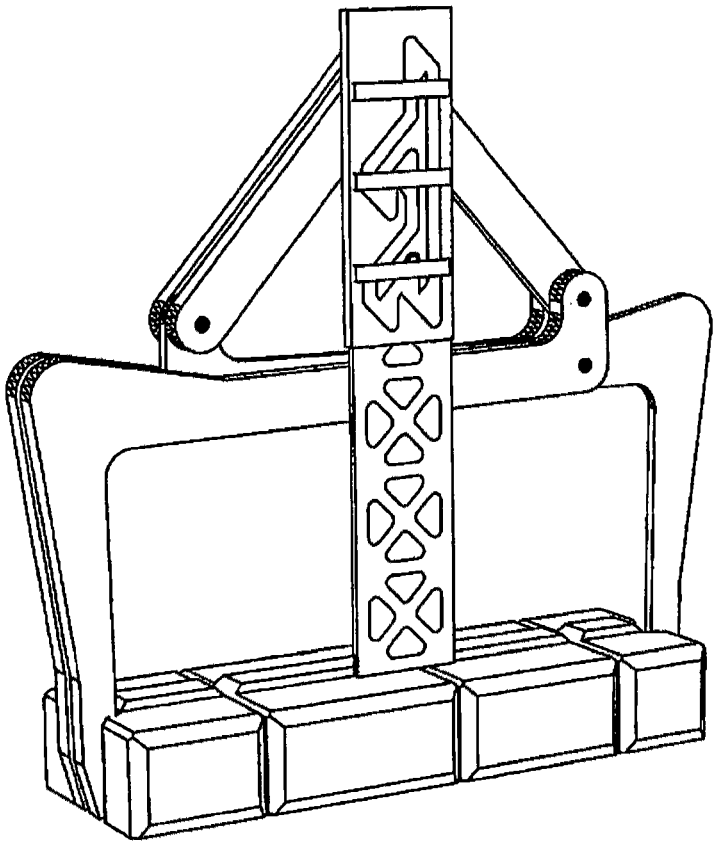
Figure 9:
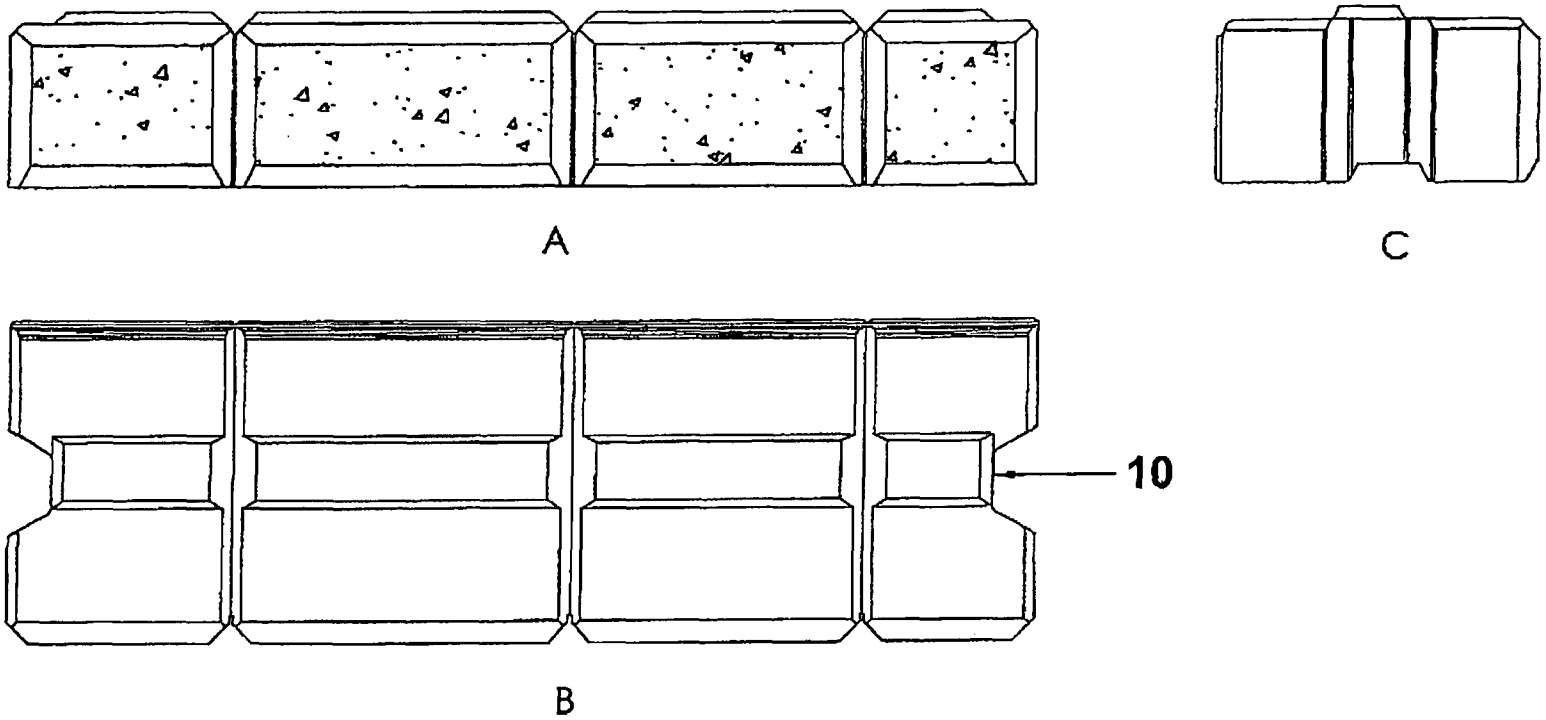

FIGS. 6A to C are face, top and side views of the indexing system;

FIG. 7 is a perspective view of the indexing system;

FIG. 8*a* is a perspective view of the clamp with three units in bay area;

FIG. 8*b* is a perspective view of the clamp with two units in bay area;

FIG. 8*c* is a perspective view of the clamp with one unit in bay area;

FIGS. 9A to C are face, top and side views of an SRW block with vertical side grooves numbered 10, which grooves are devised to accommodate the clamp arms and allow units to be placed immediately adjacent to one another on the wall.

DETAILED DESCRIPTION OF THE INVENTION

Figure 1:
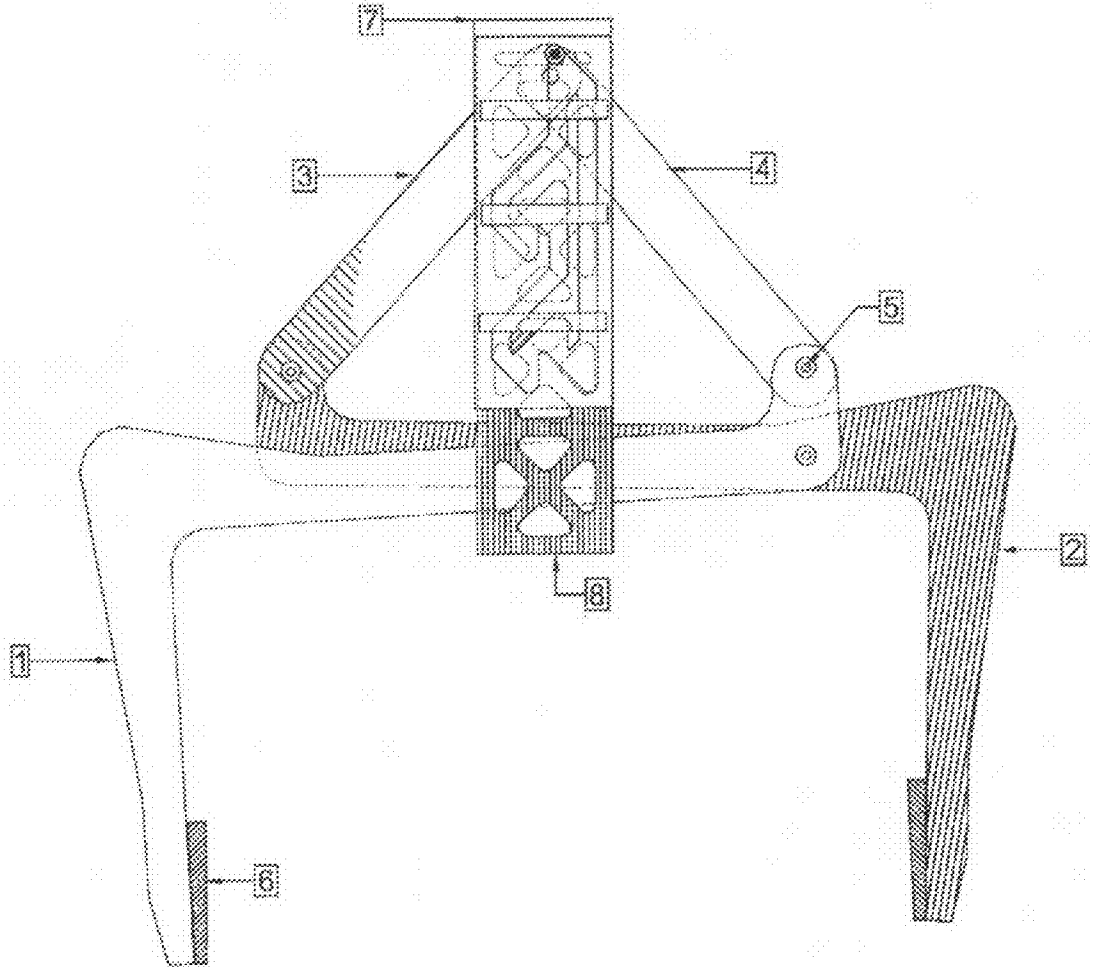
FIG. 1 is a front view of a frictional, indexing, mechanical scissor clamp according to a preferred embodiment of the invention, in which the following numbers represent.
Figure 2:
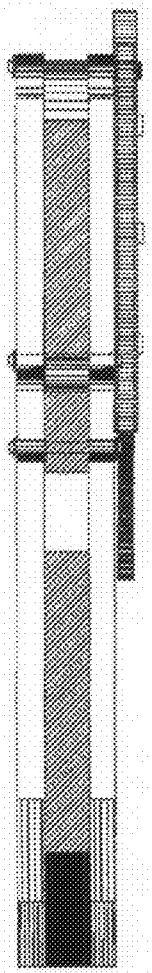
FIG. 2 is a side view of the clamp shown in FIG. 1.
Figure 3:
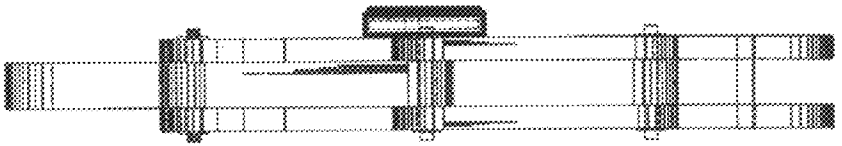
FIG. 3 is a top view of the clamp.
Figure 4:
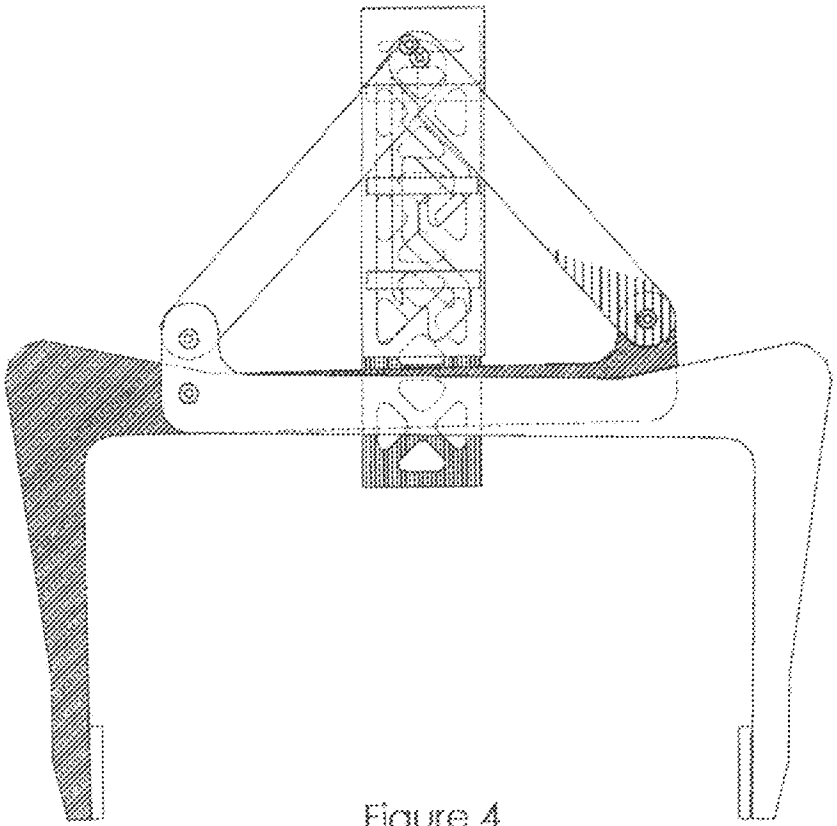
FIG. 4 is a rear view of the clamp.
Figure 5:
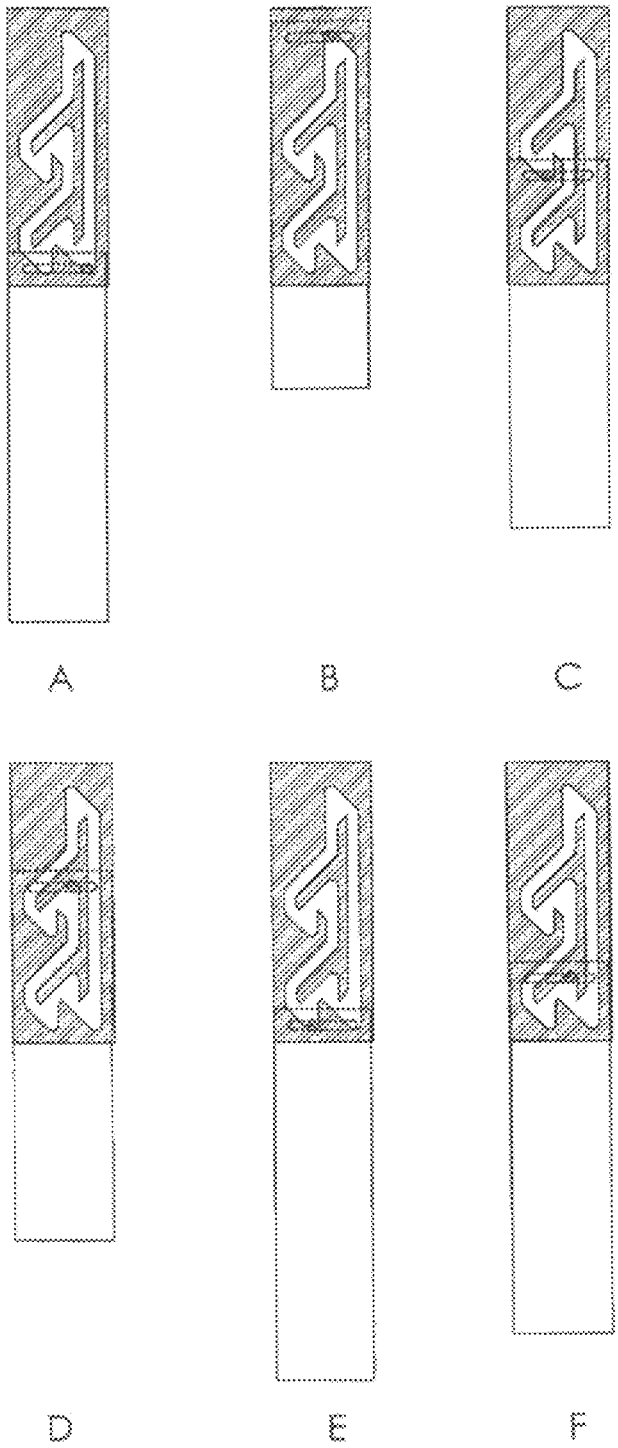

Referring to FIG. 5, the sequence of operation of the scissor clamp according to the invention, is as follows.

The indexing foot begins at position "A" in the slotted indexing template. The clamp is lowered over the stack of blocks (in this example, three blocks). As the clamp is lowered, the indexing foot contacts the top of the stack and the foot is pushed up the index element, stopping at position "B". At this location, the indexing foot is at the highest travel point, and therefore, the gripping arms of the clamp are at the lowest (bottom of the stack—Refer to FIG. 8). With the gripping arms contacting the sides of the lowest block, the clamp is lifted upward.

During the upward motion, the scissor clamp grips the lowest block tightly. With the lowest block securely held, the entire stack is lifted and moved to the wall. The stack is then lowered on to the wall. As the stack and clamp are lowered, the clamp locking mechanism locks the arms in the "open" position. Once the arms are locked, the clamp is then lifted and the arms slide up the stack (within the vertical grooves), leaving the bottom block in place on the wall. The index foot moves to position "C" as the clamp is being lifted, where it catches in the bottom of the channel. Once the foot catches, essentially setting the new "bay" size (from 3 units to 2 units), the clamp is then dropped again, pushing the pin into the "D" position. This action unlocks the clamp arms in the new "2 blocks" position. As with the "B" position, the clamp is ready to pick up the remaining units on the stack, and the arms grip the lowest block as before. The cycle is continued again, lowering the clamp and blocks, placing the bottom unit, shifting the clamp up to the next unit to be placed, and lifting. Once all blocks are placed, the clamp moves back to the pallet to pick up the next stack of units. A pin hole has also been included which allows the contractor to lock the index foot in the "F" position, restricting the clamp to picking up 1 unit at a time.

As can therefore be understood, the invention relates to an indexing, multi-unit scissor clamp that allows for the placement of multiple SRW blocks during construction.

In accordance with the invention, such is achieved as follows:

a. Extending the gripping arms to a length that allows multiple units to be placed.
b. Shaping the gripping arms to allow them to fit into pre-formed recesses in the ends of the block, allowing a parallel orientation.
c. Employing the concept of an indexing foot to create multiple "bay" sizes within the clamp area. The multiple bay sizes specifically accommodate one or more SRW blocks.
d. Employing the concept of a pre-determined travel path to automatically move the indexing foot to the required travel length, and therefore, bay size for various different SRW block combinations. Through the simple process of lifting and dropping the clamp, the sequence of SRW blocks is cycled through, starting at the largest number (largest bay size) and ending at one unit. The travel path is created as a free moving pin, attached to the indexing foot, is directed through a channel consisting of a sequence of start, stop, and travel segments. The configuration of the channel works in concert with the clamp locking mechanism, block dimensions (bay sizes), and cycle of lifting and lowering the blocks that is required for block installation.

As it was already mentioned before, the existing scissor clamps are limited to placing one SRW block at a time. The efficiency of installation is therefore limited to one SRW block per installation cycle. This, in turn, limits the potential for greater productivity and cost savings in man and machine time during construction.

Moreover, the existing scissor clamps grasp the block in the following two ways:

i. Perpendicular to the block (gripped from the front and back face). This requires that the columns of SRW blocks on the pallet be separated to allow for the clamp to fit into place. This process requires a worker to manually move (crow bar) these relatively heavy concrete blocks. This step is time consuming and can be dangerous. Also, as the front face of some SRW blocks have a split-rock finish, ice has been known to accumulate on this rough surface. Ice build up, on and within the textured face can cause a loss of friction at the face/clamp pad interface.

ii. Parallel to the block (end to end). This method allows for units to be picked up by the ends, and therefore does not require the worker to separate the blocks at the face. However, current clamp/block systems are not recessed at the ends, and therefore, the units are not able to be placed directly adjacent to one another on the wall due to the clamp arm being an obstruction. The block must be placed on the wall and the clamp removed. The placed block must be shifted manually down the wall to abut the adjacent unit.

The clamp/block combination according to the invention, addresses the above problems as follows:

a. Thanks to the vertical grooves, formed into the end of the SRW block, the clamp arms are recessed into the block, thereby allowing the blocks to be placed immediately adjacent to one another on the wall.

b. As the blocks are picked up end to end (parallel), the issue of separating the face of the blocks at the bundle is overcome.

c. As the blocks are picked up end to end, and the vertical grooves which take the clamp arms are formed of smooth concrete, the issue of ice forming at the interface is greatly reduced.

So, the present invention is clearly an improvement to the existing equipment.

The invention claimed is:

1. A multiple-unit indexing mechanical scissor clamp for handling one or more modular segmental retaining wall units, each segmental retaining wall unit having opposite ends each provided with a vertical groove, wherein said multiple-unit indexing mechanical scissor clamp comprises:

a rigid clamp arm sized to fit into one of the grooves of the one or more modular segmental retaining wall units;

a moving clamp arm pivotably connected to the rigid clamp arm and sized to fit into the opposite groove of the one or more modular segmental retaining wall units, a pair of hanger bars having upper ends pivotably connected to each other by a horizontal pin that is slideably moveable up and down into a groove forming a travel path with different holding positioning in a vertical indexing element, said hanger bars also having bottom ends respectively connected to the rigid and moving clamp arms in order to allow the rigid and moving clamp arms to open and close while the pin moves through the travel path; and an indexing foot also connected to the horizontal pin, said indexing foot being slideably mounted into the vertical indexing element and projecting downwardly from the vertical indexing element to be able to contact a modular segmental retaining wall unit located just below the indexing foot, whereby, in use, positioning of the multiple-unit indexing mechanical scissor clamp onto one or more stacked modular segmental retaining wall units causes the indexing foot to move up and thus to cause the pin to move up also through the travel path until the pin reaches a suitable position where the rigid and moving clamp arms are actuated to catch a modular segmental retaining wall unit in a lower position of the one or more stacked modular segmental retaining wall units, and allow the modular segmental retaining wall unit in the lower position and any other modular segmental retaining wall unit stacked on the modular segmental retaining wall unit in the lower position to:

be lifted together and to be left after the rigid and moving clamp arms of the multiple-unit indexing mechanical scissor clamp are moved to the open position.

2. The multiple-unit indexing, mechanical scissor clamp according to claim 1, wherein each of said rigid and moving clamp arms is provided with a rubber friction pad positioned to fit into the corresponding groove of the modular segmental retaining wall unit.

* * * * *